US006422404B2

(12) United States Patent
Schmidt et al.

(10) Patent No.: US 6,422,404 B2
(45) Date of Patent: Jul. 23, 2002

(54) FANNED SHELF DISPLAY

(75) Inventors: Mark T. Schmidt; Heidi A. Meyer, both of Madison; Daniel Doucette, DeForest, all of WI (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/758,328

(22) Filed: Jan. 11, 2001

Related U.S. Application Data

(60) Provisional application No. 60/175,745, filed on Jan. 12, 2000.

(51) Int. Cl.[7] ..... A47F 5/08
(52) U.S. Cl. ..... 211/90.04
(58) Field of Search ..... 211/90.04, 88.01, 211/119.003, 134, 153; 108/59, 108; D6/460

(56) References Cited

U.S. PATENT DOCUMENTS

| | | | | | |
|---|---|---|---|---|---|
| 800,032 | A | * | 9/1905 | Turner | |
| 1,560,122 | A | | 11/1925 | Vance | |
| 1,824,813 | A | | 9/1931 | Friedemann | |
| D85,980 | S | | 1/1932 | Foretich | |
| 1,908,928 | A | | 5/1933 | Stein | |
| D163,315 | S | * | 5/1951 | Newton | |
| D180,617 | S | | 7/1957 | Patterson | D80/10 |
| D194,727 | S | | 2/1963 | Amigone | D80/10 |
| 3,207,321 | A | * | 9/1965 | Joyce | |
| 3,479,990 | A | | 11/1969 | Crow | 119/1 |
| 3,581,906 | A | * | 6/1971 | Joyce | |
| 3,863,575 | A | | 2/1975 | Kuns et al. | 108/111 |
| 4,072,235 | A | * | 2/1978 | Munoz | |
| D249,301 | S | | 9/1978 | Ehrlich | D6/28 |
| 4,228,906 | A | * | 10/1980 | Jones | |
| D264,278 | S | | 5/1982 | Waines | D6/28 |
| 4,506,790 | A | | 3/1985 | Muscari | 211/59.4 |
| D284,052 | S | | 6/1986 | Blunden | D6/457 |
| 4,928,832 | A | | 5/1990 | Overman | 211/187 |
| 5,575,444 | A | | 11/1996 | Otema | 248/242 |
| D401,810 | S | * | 12/1998 | Swift | |
| 5,871,108 | A | | 2/1999 | White | 211/186 |
| D411,697 | S | | 6/1999 | Hannecke | D6/460 |

* cited by examiner

*Primary Examiner*—Alvin Chin-Shue
*Assistant Examiner*—Sarah Purol
(74) *Attorney, Agent, or Firm*—Fitch, Even, Tabin & Flannery

(57) ABSTRACT

A shelf display is provided with a two dimensional array of separate spaced apart shelves which are fanned out in a horizontal direction. The shelves extend from a back wall inclined from the vertical and may be arranged either in columns or staggered from one row to another. The shelves are recessed so as to receive merchandising cartons and to provide support for the merchandising cartons as individual product units are removed therefrom. The shelves are spaced apart to allow light to enter the lower rows.

19 Claims, 7 Drawing Sheets

FANNED SHELF DISPLAY

This application is a continuation-in-part of application Ser. No. 60/175,745, filed Jan. 12, 2000.

BACKGROUND OF THE INVENTION

1. Field of the Invention

The present invention pertains to shelf displays and in particular to shelf displays adapted to hold merchandising Cartons.

2. Description of the Related Art

A number of different display racks and display stands have been proposed in past years. Broadly, one category of display racks includes multiple compartments but the compartments are formed as a partitioned continuous shelf. When arranged in tiers from top to bottom, the upper shelves being continuous, block overhead light from reaching the lower shelves. Accordingly, it is common that the tiered shelves be reduced in size with the uppermost shelves being the smallest size. However, a considerable amount of light is still blocked from reaching the lower shelves.

In another broad category of display shelves, a plurality of individual supports are provided to support different groups of product units. Many of the shelving displays provide hanging support for product units or are adapted for rigid products such as wine bottles. Improvements in merchandising racks are still being sought.

SUMMARY OF THE INVENTION

It is an object of the present invention to provide a display rack for merchandising cartons.

Another object of the present invention is to provide a display rack having a plurality of individual shelves separated from one another and fanned out to provide an attractive presentation to the consumer.

Another object of the present invention is to provide a display rack of the type described above in which the individual shelves are fanned out in both horizontal and vertical directions.

Yet another object of the present invention is to provide a display rack of the above type in which the products being displayed are securely retained against gradation and forces inadvertently applied when consumers access products carried on the display rack.

These and other objects of the present invention are provided in a fanned shelf display, having a support wall. A plurality of shelves extend outwardly from the support wall with rear ends joined to the support wall so as to receive cantilever support therefrom. The shelves are arranged in a two-dimensional array, and are fanned out in a horizontal direction.

DETAILED DESCRIPTION OF THE PREFERRED EMBODIMENTS

Figure 1:
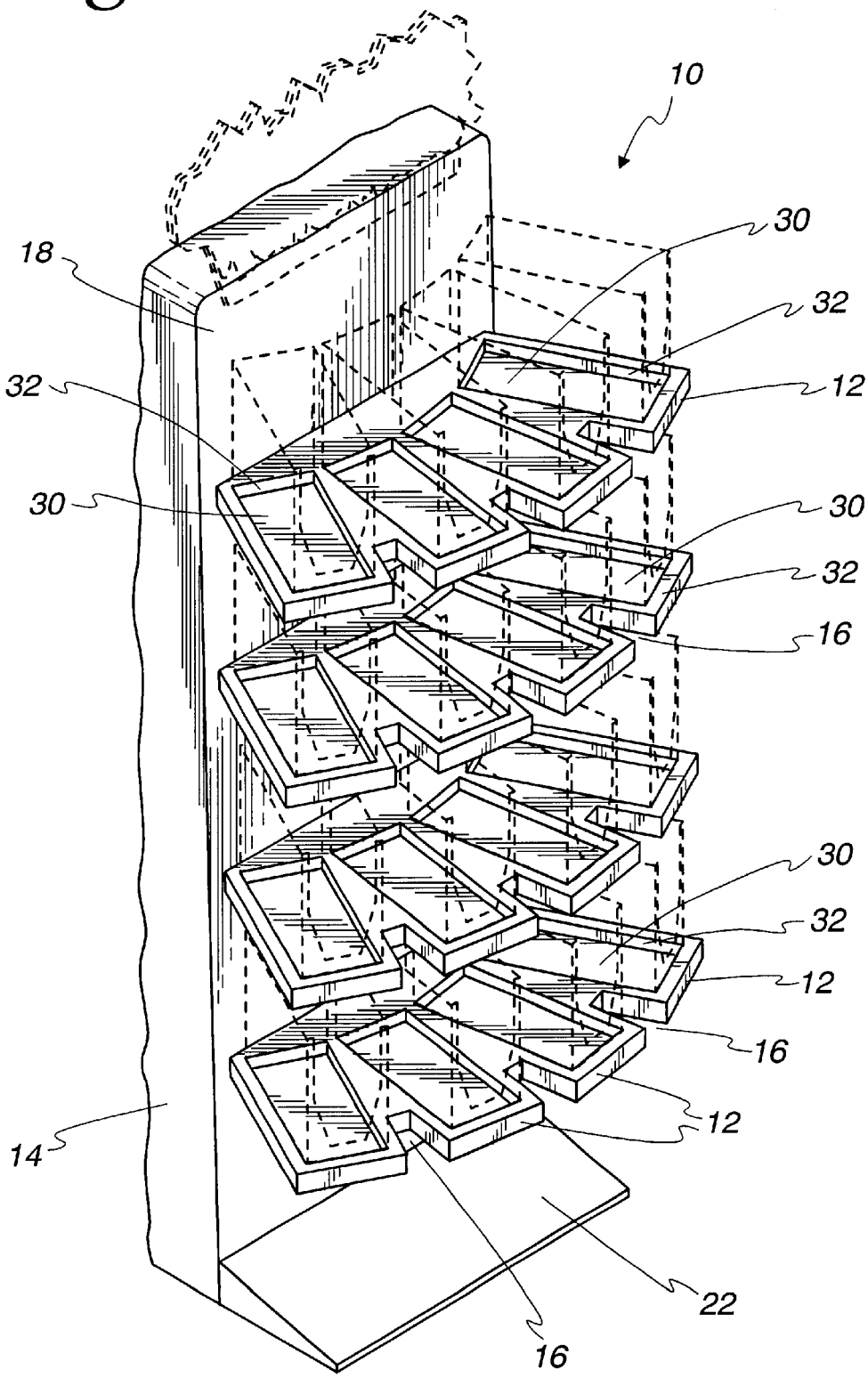
FIG. 1 is a perspective view of a shelf display according to the invention.

Referring now to the drawings, and initially to FIGS. 1–7, a shelf display generally indicated at 10 includes a plurality of shelves 12 projecting from a common back wall 14. The shelves 12 extend in generally horizontal directions, although, as will be seen herein, the shelves are preferably inclined at slight angles above the horizontal. Shelves 12 are joined at their rear ends to back wall 14 in a conventional manner so as to receive cantilever support therefrom. As can be seen for example in FIG. 4, the individual shelf units of a row of shelves are preferably formed from monolithic material such as wood, plastic or the like. Shelves 12 are separated by relatively deep notches 16. Alternatively, the shelves 12 can be completely independent from one another, being separately formed and separately secured to back wall 14.

Back wall 14 may be of virtually any shape, but preferably has a shape which presents a flat planar surface to the shelves. As can be seen in FIG. 1, back wall 14 has an outer surface 18 which is inclined from the vertical. In the preferred embodiment, back wall 14 has a stabilizing foot 22 and a generally vertical rear surface 24 (see FIG. 3). Accordingly, back wall 14 has a generally wedge-shaped profile when viewed from its side (see FIGS. 6 and 7).

Figure 2:
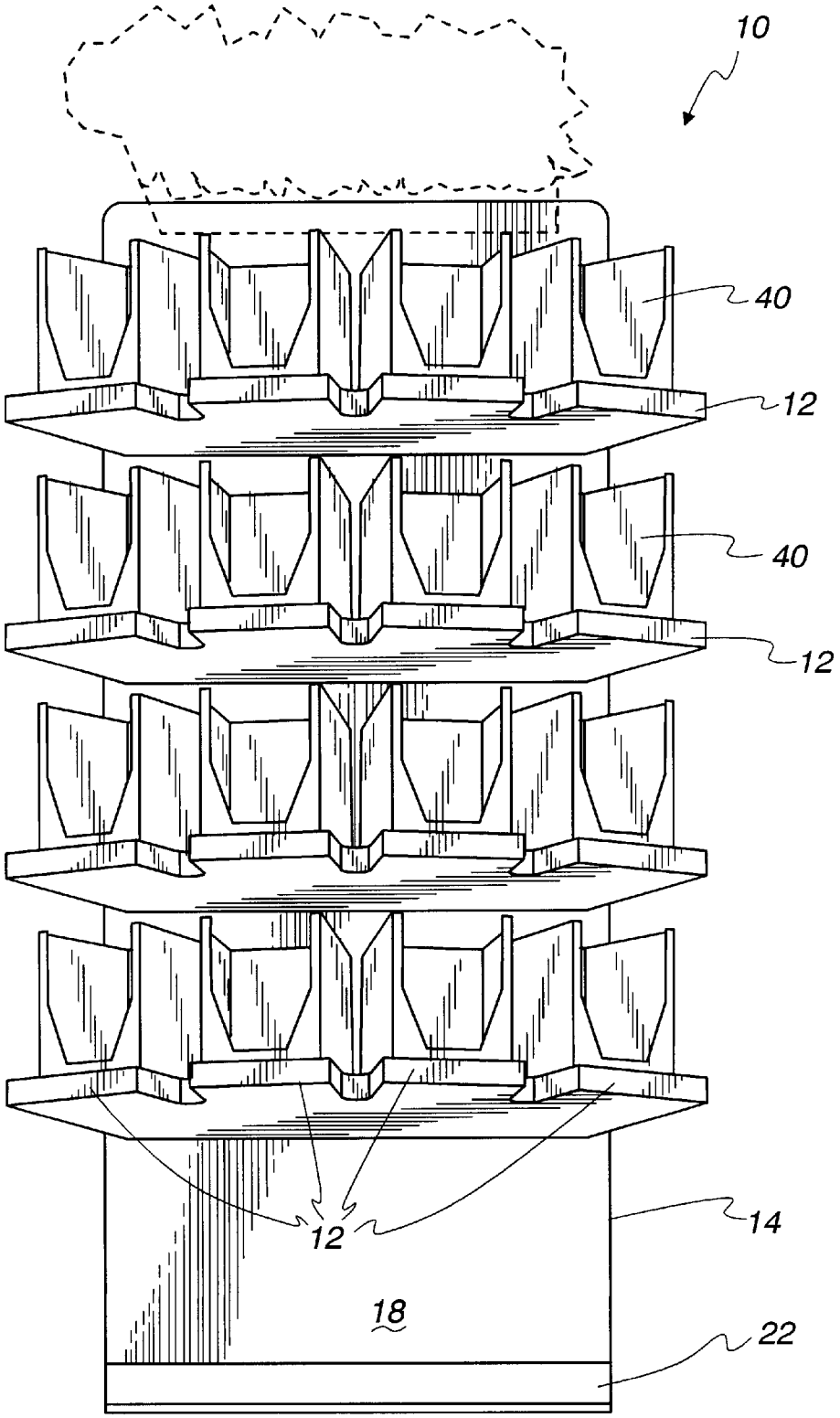
FIG. 2 is a front elevational view thereof.
Figure 3:
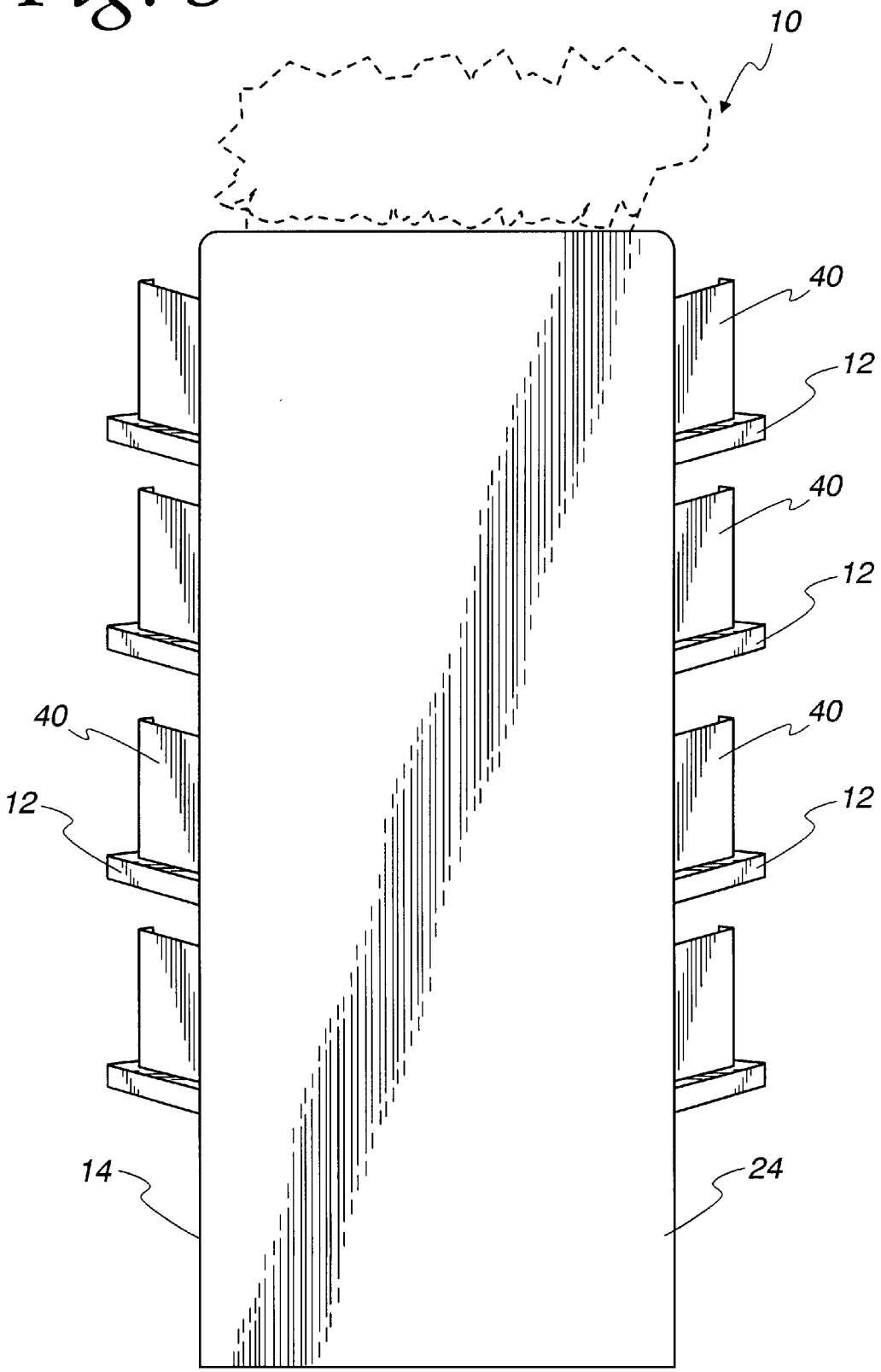
FIG. 3 is a rear elevational view thereof.
Figure 4:
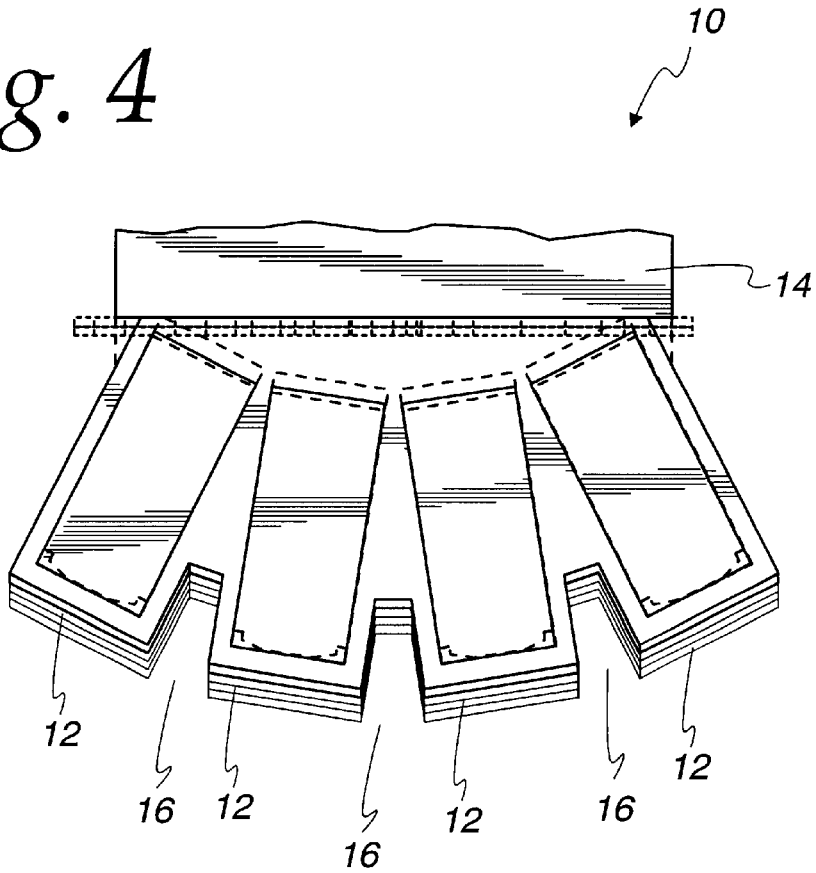
FIG. 4 is a top plan view thereof.
Figure 5:
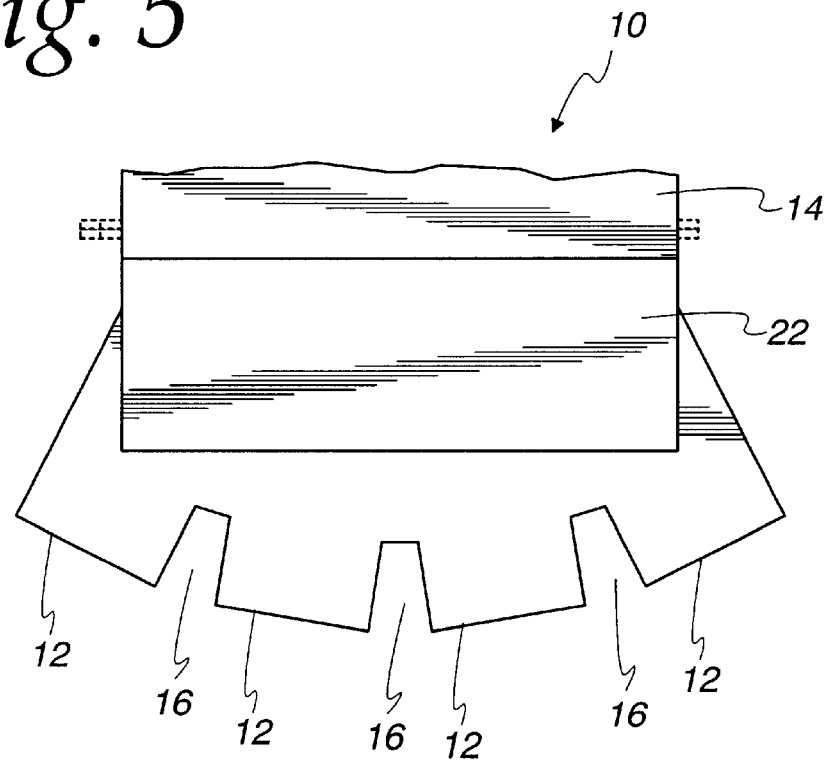
FIG. 5 is a bottom plan view thereof.
Figure 9:
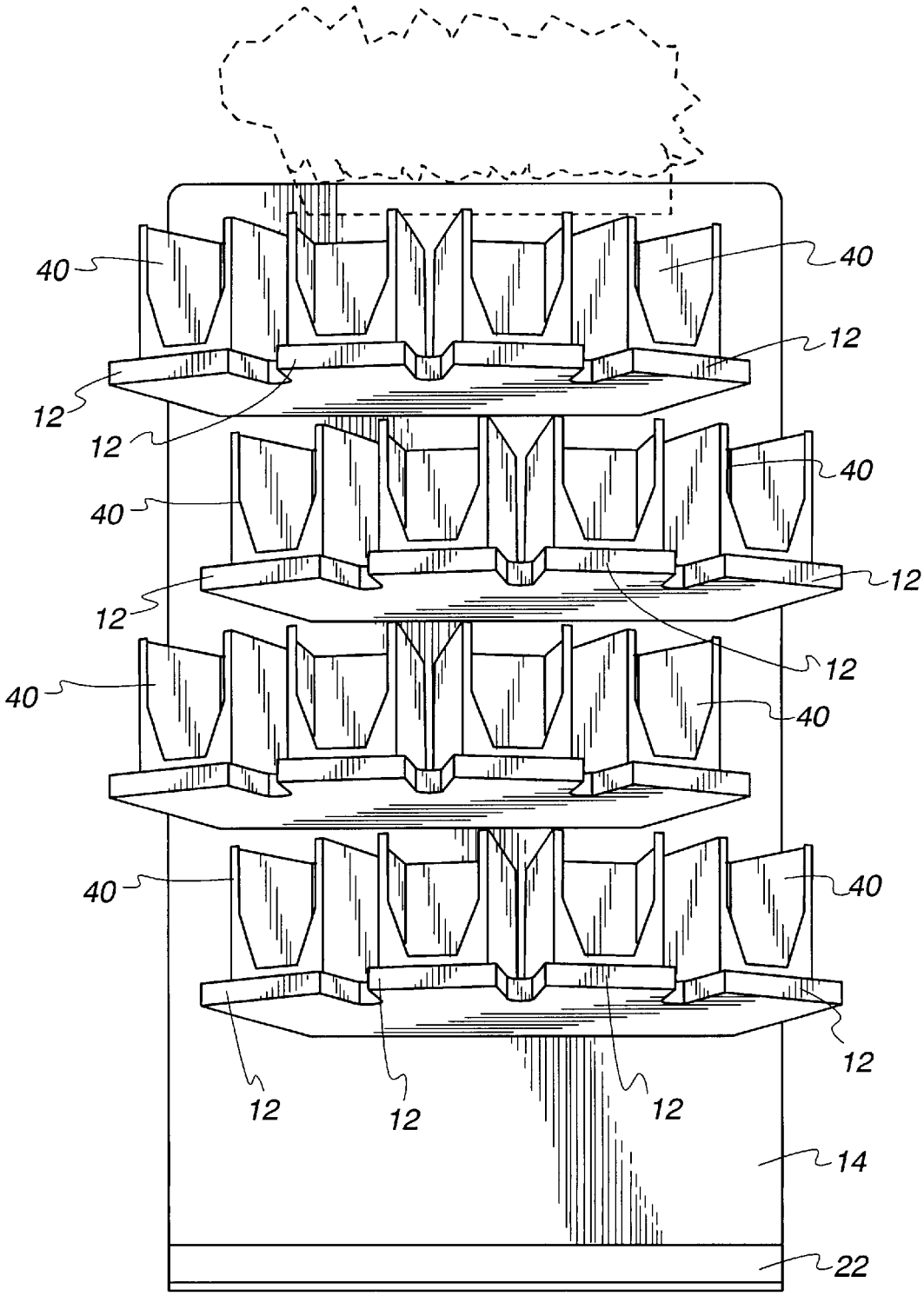
FIG. 9 is a front elevational view of a second alterative embodiment similar to the shelf display shown in FIG. 2 but having staggered rows of shelves.

As can be seen for example in FIG. 2, the plurality of shelves 12 are separated one from another and are arranged in a modified rectilinear array, including four rows and four columns. As mentioned above, the shelves are fanned out in a horizontal direction, with the shelves of a row preferably angularly displaced one from another. In the embodiment shown in FIGS. 1–7, the angular displacements for the shelves of each row is the same from row to row. The shelves may also be staggered from one row to another as shown, for example in FIG. 9, where the shelves of the bottom row, for example, are aligned between pairs of shelves of the upper row. Generally, the angular displacement-between adjacent shelves of the rows of FIG. 9 is the same angular displacement as that employed in FIG. 1.

As mentioned above, the back wall 14 of the illustrated embodiment is generally flat and the back ends of the shelves are attached to the back wall such that they form a two-dimensional array fanned out in a horizontal direction. As shown in the drawings, it is generally preferred that the shelf units remain within the side margins of the back wall. However, if desired, the shelf units can be enlarged to extend beyond the side edges of the back wall. Arrangements of this type would allow increased lighting at the lateral edges of the shelves and, if desired, could be made to increase reflected light between adjacent shelves.

As mentioned, the shelves may be made of wood or of composite or artificial material. When entirely separately formed, the individual shelves are made generally similar to one another except for their rear ends which receive compound miter cuts to form the two-dimensional array, fanned out in a horizontal direction and inclined in a vertical direction. In the preferred embodiment, shelves 12 are formed from a monolithic member. Upstanding walls 32 of adjacent shelves are merged together to form a notched V-shaped divider portion visible, for example, in FIG. 1. In the preferred embodiment, the display shelf is made to receive disposable merchandise cartons 40, each carton containing a plurality of product units. If desired, the merchandise cartons 40 can remain with the shelf display so as to form a shelf display system. In either event, referring to FIGS. 6 and 7, it is generally preferred that the back wall 14 be inclined from the vertical such that gravitational forces urge merchandising cartons 40 disposed on the shelves to have a slight downward slope. If desired, although less preferable, back wall 14 can be positioned in a vertical or near vertical direction, and any desired inclination of the shelves can be adjusted in their design, or in the design of their attachment to the back wall. Preferably, the shelves are mounted to the back wall by a bayonet-type arrangement (not shown) in which pins or tabs project from the shelves so as to enter mounting openings formed in the back wall. Inclination of the back shelves can be conveniently adjusted by either changing the angle of the mounting openings with respect to the back wall, or changing the angles with which the pins or tabs extend from the shelves at a modified angle.

Further variations are possible with a "bayonet" mounting of the shelves to the backing wall. For example, the pins or tabs of the bayonet mount can be varied in length as desired, to allow shelf elements to extend varying distances from the backing wall. For example, it may be desirable to set lower shelf elements outwardly away from the backing wall to increase their exposure and the amount of light penetrating into the space between vertically adjacent shelf elements.

The shelves 12 are preferably recessed for a socket-like fit with the merchandising cartons as can be seen, for example, in FIG. 1 where the recessed bottom walls 30 are framed at their outer perimeters by upstanding walls 32. The socket-like fit between the merchandising cartons 40 and the recessed bottom walls of shelves 12 provides secure support for the merchandising cartons, even when the cartons are formed of light weight, semi-rigid construction, such as thin gauge single ply paperboard. When the merchandising cartons are filled with product, the resulting package is fairly rigid, but as product is withdrawn from the merchandising carton, internal support for the carton is removed and the carton becomes considerably more flexible.

It is preferred that the bottom walls 30 of the shelves 12 be solid and continuous, as shown. With respect to FIG. 4, for example, the rear upstanding wall 12*a* can be omitted, with bottom wall 30 extending to back wall 14. This type of arrangement is particularly attractive where raised portion 12*b* is also omitted, allowing bottom walls 30 to blend into a bayonet mounting tab extending into back wall 14, although they could also have an open mesh or the like construction. If merchandising cartons are made sufficiently rigid so as to be relatively self-supporting, the bottom walls of shelves 12 could be made more open (e.g., cross members or a relatively coarse mesh).

As shown, the recessed bottom walls 30 of shelves 12 are dimensioned with a relatively tight fit with the merchandising cartons 40, and are arranged such that the upstanding walls 32 of the shelves wrap around the outside corners of the merchandising cartons. This allows the walls of the merchandising cartons 40 to remain relatively rigid, even when a major portion of the front wall is removed, as shown in FIG. 2, for example, to allow easy extraction of product units contained at the back of the carton. Due to the preferred socket-like fit of the merchandising carton within the recessed shelves, the merchandising cartons are secured against gravitational forces. The inclining of back wall 14 is preferably provided for assured containment of loose product units, preventing product units (especially product units wrapped in relatively "slippery" film) from inadvertently sliding out the front of a merchandising carton. In this manner, adequate securement of loose product units within merchandising cartons can be attained with an open, light-filled fanned display.

Figure 8:
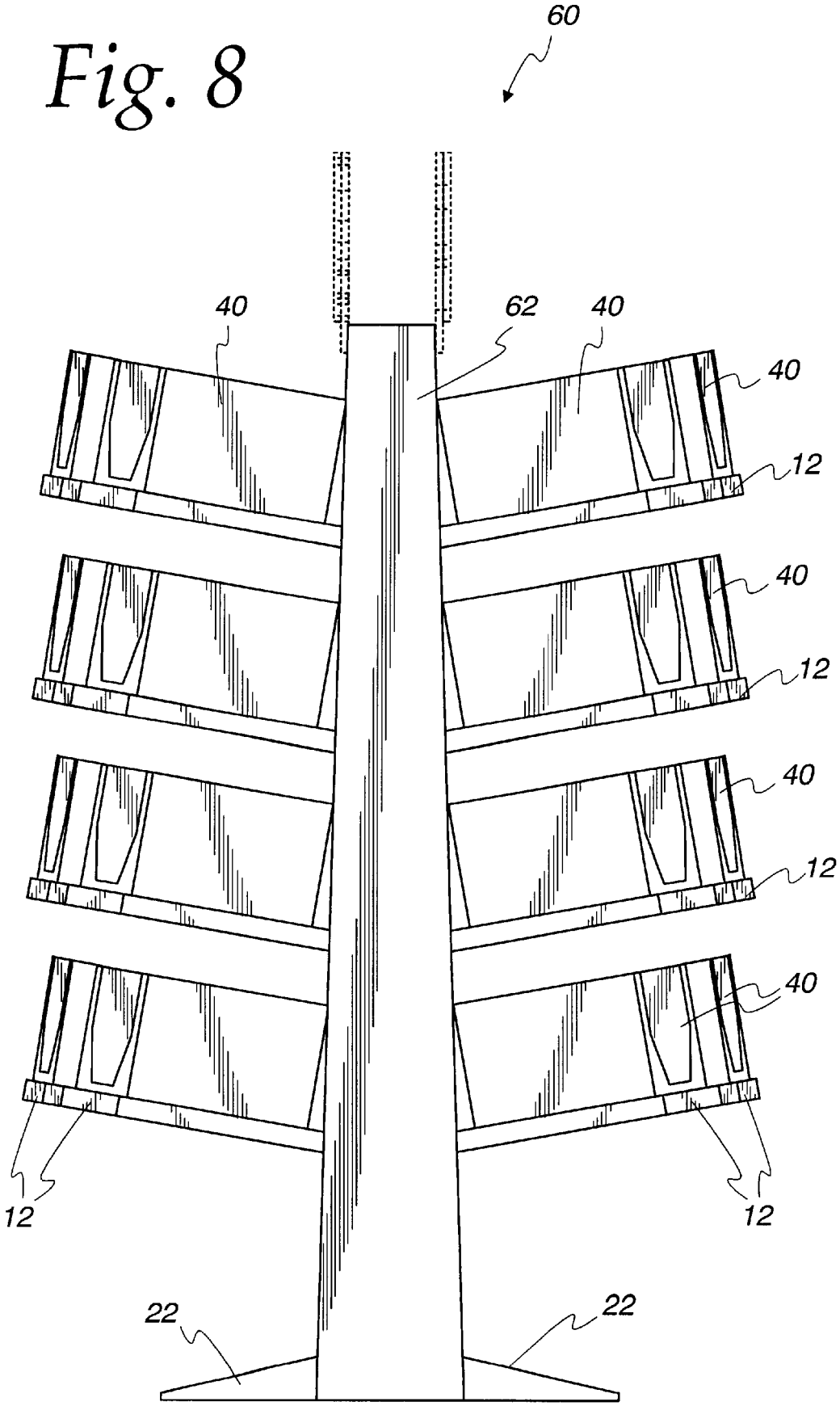
FIG. 8 is a side view of a first alternative embodiment similar to the embodiment shown in the preceding drawings, except for being double sided.

Variations to the above described arrangement are possible. For example, with reference to FIG. 8, a double-sided shelf display is generally indicated at 60. Functionally, the double-sided display, 60 comprises two single-sided shelf displays 10 arranged back to back. Double-sided shelf display 60 can be formed with two back walls 14 secured together in back-to-back relationship or a single monolithic support wall 62 can be provided, as shown.

Figure 6:
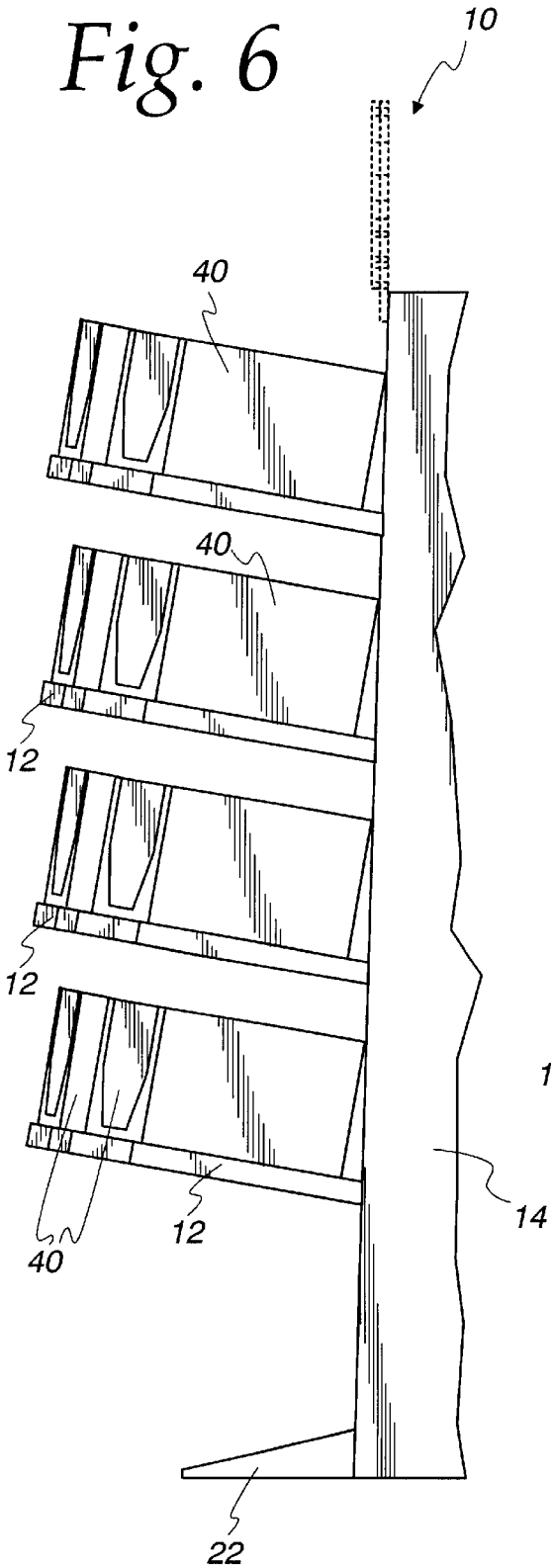
FIG. 6 is a side elevational view from one side thereof.
Figure 7:
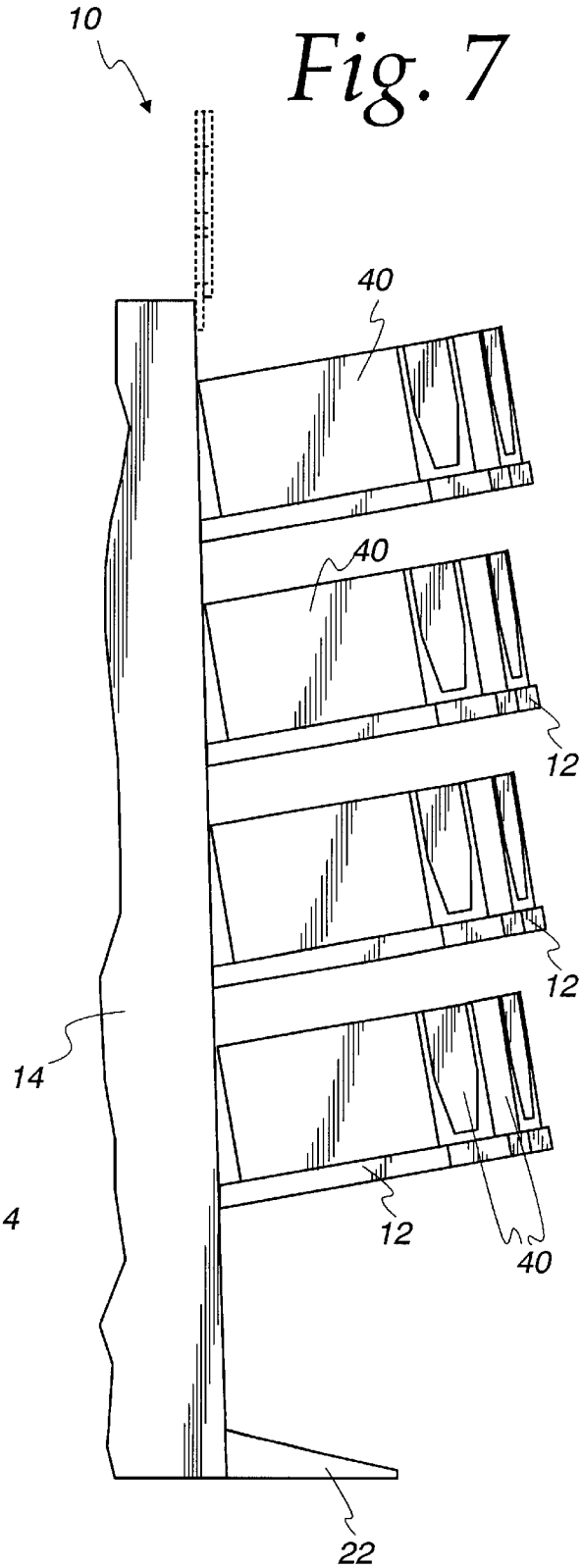
FIG. 7 is a side elevational view from the other side thereof.

In a circular arrangement, the support wall can take the form of a truncated cone which will readily accommodate rows of shelves which are fanned out at regular angular displacements, whether the shelves are arranged in columns or in staggered rows. As mentioned, in the preferred embodiment described above the rows of shelves are fanned out in a horizontal direction and are inclined at uniform angles as can be seen in FIGS. 6 and 7. The present invention also contemplates that the shelves may be arranged in vertical directions such that the shelves are fanned out, being inclined at different vertical angles from the back wall. This gives the shelf display a "starburst" configuration, that is, fanned out in both vertical and horizontal directions. If desired, the shelves in this alternative arrangement can be separately formed and, when a flat back wall is employed, compound miter cuts or the like will be required for the back walls of each shelf. As an alternative, the back wall can be made convex, allowing the individual shelves to be identically formed.

In certain instances, the socket-like fit described above may not be necessary and accordingly the inclination of the back wall may provide additional benefit by assuring adequate support of the merchandising cartons, preventing them from falling off the front of the shelves.

As mentioned, one important advantage of shelf, displays according to principles of the present invention is that overhead light is allowed to enter the lower rows of the display and-accordingly it is preferred that the individual shelves of a row be separately formed and spaced one from the other, at least at their forward edges. As will be readily appreciated by those skilled in the art, it is possible to practice the present invention by providing either totally separate shelves, or a common support for all of the shelves of a row, provided the common support allows light to pass to lower rows. Examples of such common supports which are not notched, as shown, include translucent and transparent materials such as glass and plastic as well as open wire frame construction.

In a further variation of the present invention, not shown, a lighting fixture can extend from the back wall, above the uppermost shelving row. Such arrangements allow shelving displays according to principles of the present invention to be positioned in darker portions of a commercial establishment or in fairs or carnivals or the like outdoor operations carried out in the evening hours.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A fanned shelf display, comprising:

a support wall;

a plurality of shelves extending outwardly from the support wall and having rear ends joined to the support wall so as to receive cantilever support therefrom;

said shelves having a recessed central portion for receiving a merchandise carton; and said plurality of shelves arranged in a two dimensional array, fanned out in a horizontal direction.

2. The shelf display of claim 1 wherein said support wall is generally flat.

3. The shelf display of claim 2 wherein said support wall is inclined from the vertical.

4. The shelf display of claim 1 wherein said plurality of shelves are arranged in a plurality of horizontally extending rows.

5. The shelf display of claim 4 wherein said plurality of shelves are also arranged in vertical columns.

6. The shelf display of claim 4 wherein the shelves of one row are staggered with respect to the shelves of an adjacent row.

7. The shelf display of claim 1 wherein said plurality of shelves are also fanned out in a vertical direction.

8. A fanned shelf display comprising:

a support wall;

a plurality of shelves extending from the support wall;

said plurality of shelves being arranged in horizontally extending rows;

said shelves having a recessed central portion for receiving a merchandise carton; and the rows of shelves being angularly offset one from another by either vertical or horizontal angular offset amounts, or both.

9. The shelf display of claim 8 wherein said plurality of shelves are also arranged in vertical columns.

10. The shelf display of claim 8 wherein the shelves of one row are staggered with respect to the shelves of an adjacent row.

11. The shelf display of claim 8 wherein said support wall is generally flat.

12. The shelf display of claim 8 wherein said support wall is inclined from the vertical.

13. A shelf display system, comprising:

a support wall;

a plurality of shelves extending outwardly from the support wall and having rear ends joined to the support wall so as to receive cantilever support therefrom;

said plurality of shelves arranged in a two dimensional array, fanned out in vertical and horizontal directions; and a plurality of cartons disposed on respective ones of said shelves.

14. The display system of claim 13 wherein said shelves have a recessed central portion for receiving the bottom portions of said cartons.

15. The shelf display of claim 13 wherein said support wall is inclined from the vertical.

16. The shelf display of claim 13 wherein said plurality of shelves are arranged in a plurality of horizontally extending rows.

17. The shelf display of claim 16 wherein said plurality of shelves are also arranged in vertical columns.

18. The shelf display of claim 16 wherein the shelves of one row are staggered with respect to the shelves of an adjacent row.

19. The shelf display of claim 13 wherein said plurality of shelves are also fanned out in a vertical direction.

* * * * *